US005205420A

United States Patent [19]

Petryszak

[11] Patent Number: 5,205,420

[45] Date of Patent: Apr. 27, 1993

[54] ADJUSTABLE AND SELF-LOCKING BOOK RACK OR BOOK SUPPORT

[76] Inventor: Joseph Petryszak, Box 116, Bruceton Mills, W. Va. 26525

[21] Appl. No.: 871,012

[22] Filed: Apr. 20, 1992

[51] Int. Cl.[5] ..... A47F 5/00

[52] U.S. Cl. ..... 211/43; 211/184

[58] Field of Search ..... 211/43, 42, 184; 108/61

[56] References Cited

U.S. PATENT DOCUMENTS

| | | | |
|---|---|---|---|
| D. 185,103 | 5/1959 | Sutton | 211/43 X |
| 527,897 | 10/1894 | Stikeman | 211/43 |
| 583,494 | 6/1897 | Lundberg | 211/43 |
| 1,674,359 | 6/1928 | Frey | 211/43 X |
| 1,780,872 | 11/1930 | Dumben | 211/43 |
| 3,063,567 | 11/1962 | Campbell | 211/43 |
| 3,318,454 | 5/1967 | Donlin | 211/43 |

FOREIGN PATENT DOCUMENTS

| | | | |
|---|---|---|---|
| 59978 | 9/1947 | Netherlands | 211/43 |

*Primary Examiner*—Robert W. Gibson, Jr.
*Attorney, Agent, or Firm*—Robert T. Crawford

[57] ABSTRACT

An adjustable and self-locking rack or support for firmly holding one or more books or the like in an upright position on a planar base member. The rack includes a pair of manually adjustable bookends having dovetails thereon which are slidably received in a longitudinally extending dovetail groove in the base member. The bookends are thus slidable or adjustable on the base member and, when moved into engagement with the books, are automatically self-locked to the base member due to the lateral pressure of the books to thereby firmly hold the books in an upright position on the base member.

24 Claims, 7 Drawing Sheets

ADJUSTABLE AND SELF-LOCKING BOOK RACK OR BOOK SUPPORT

Field of the Invention

The invention relates to a book rack or book support, and more particularly, to an adjustable and self-locking rack or support wherein a pair of bookends are manually adjustable or movable on an underlying base member and, when moved into engagement with a book or the like, are automatically self-locked to the base member to firmly hold the books in position on the base member.

Background of the Invention

The term "book", "books" or "books or the like" is meant to include, but not be limited to, a single book, a plurality of books, hard cover books, paperbacks, catalogues, phone books, magazines, brochures, file folders, loose sheets of paper, newspapers, envelopes, phonograph records, computer disks, and other like objects adapted for storage on book shelves desks, tables or in cabinets.

There has long existed a need for an adjustable and self-locking book rack that is simple in construction, that can be easily and cheaply fabricated or manufactured without the need for special tools or tooling, that can be made of stock materials, that can be easily assembled and disassembled by hand, and that does not include any auxillary components or hardware such as nails, staples, screws, bolts, adjusting screws, compression springs, leaf springs, tension springs or magnets.

The present invention fulfills this long felt need by providing a book rack comprised of a pair of bookends that are slidably mounted on a base member through the medium or structural arrangement of a dovetail and dovetail groove. The base member has a longitudinally extending dovetail groove therein which extends the length thereof. Each bookend has a front wall for engaging a book and a bottom wall with a dovetail depending therefrom and adapted to be slidably received in the dovetail groove in the base member. The front wall and the bottom wall of each bookend intersect and form an angle of intersection of substantially ninety degrees (90°) or greater.

In using the book rack, the dovetails on the bottom walls of the bookends are first inserted into the dovetail groove in the base member from opposite ends of the base member. The bookends are then simultaneously manually moved inwardly from the ends of the base member into engagement with one or more books positioned on the base member. When the front wall of each bookend moves into engagement with a book, the front portion of each bookend is moved upwardly and the rear portion of each bookend is moved downwardly. Such movement automatically self-locks or firmly affixes the bookends to the base member. The bookends will then firmly or securely hold the books in an upright position on the base member.

The book rack of the instant invention has only two moving parts, the two bookends. The base member and the bookends are held in operative engagement by means of the dovetail and dovetail groove structural arrangement. This structural arrangement is extremely simple in construction and can easily and cheaply be fabricated or manufactured with commonly available dovetail and dovetail groove cutters. The book rack can be made of any one of several stock materials such as wood. The components of the rack because of the dovetail and the dovetail groove arrangement can be easily assembled and disassembled and, as a result of the simple structural arrangement, the rack can be sold, if desired, in the form of a kit with assembly by the purchaser, as will be more fully discussed hereinafter. The book rack more importantly does not include any auxillary components or hardware, which further decreases its cost and simplifies its construction.

Prior Art

The U.S. Patents listed below are considered to be exemplary of the prior art relating to the adjustable and self-locking book rack of the present invention as well as exemplary of the prior art relating to the structural details of the instant book rack.

| | |
|---|---|
| Harrington | 388,674 |
| Mendenhall | 431,373 |
| Stikeman | 527,897 |
| Lundberg | 583,494 |
| Warren | 603,583 |
| Ryan | 1,237,101 |
| Schimmel | 1,336,981 |
| Markham | 1,363,138 |
| Vlissingen | 1,489,804 |
| Banks | 1,682,060 |
| Dumben | 1,780,872 |
| Riddel | 1,876,346 |
| Jaquith | 1,891,420 |
| Dice | 2,294,595 |
| Lowenstein, Jr. | 2,684,765 |
| Jacobs et al | 3,171,542 |
| Donlin | 3,318,454 |
| Streuli | 3,393,793 |
| Yaremchuk | 3,974,918 |
| Anderson | 4,113,108 |
| Bross | 4,592,471 |
| Sheu | 4,682,696 |
| Gold | 4,759,449 |
| Holley | 4,925,073 |

Some of the prior art patents listed above disclose adjustable and self-locking book racks but such racks employ structures which are totally different from the structure of the instant invention. In particular, these prior patents do not disclose the use of the dovetail and dovetail groove arrangement that is employed in the instant invention to provide a rack that is both adjutable and self-locking. These prior patents also fail to disclose an adjustable and self-locking rack that firmly or securely holds the books in an upright position on the rack and yet is simple in construction and inexpensive to fabricate or manufacture. These patents whether considered singly or in combination do not disclose, suggest or teach the structural details of the present invention and do not in any way bear upon the invention as claimed.

SUMMARY OF THE INVENTION

The present invention contemplates an adjustable and self-locking book rack or book support comprising a pair of bookends which are slidably mounted on a planar base member for manual adjustment relative to each other and which are self-locking when moved into engagement with one or more books or the like to thereby firmly support the books in an upright position on the base member.

The base member has a longitudinally extending dovetail groove therein extending the length thereof and each bookend has depending from the bottom wall thereof a dovetail which is slidably received within the dovetail groove. Each bookend has a front wall for engaging a book and the front wall intersects the bottom wall of each bookend at an angle of at least 90°.

In using the book rack, the dovetails on the bottom walls of the bookends are first inserted into the dovetail groove in the base member from opposite ends of the base member. Each bookend is then simultaneously manually moved inwardly from the ends of the base member toward engagement with one or more books positioned on the base member. In moving the bookends on the base member, the bottom portion of each bookend is grasped by hand and force is applied to the bottom portion to move each bookend inwardly of the base member toward engagement with a book, with the force being applied substantially parallel to the dovetail groove in the base member.

As the front wall of each bookend moves toward engagement with a book, the top portion of each bookend will first engage the upper portion of the book. This happens because the upper portion of the book will be flaired outwardly or will be greater in width than the bottom portion of the book Also, when a plurality of books are supported on the base member in an upright position, the books will usually will not be standing in a vertical position and will thus be leaning at an angle toward the front wall or face of each bookend. When the upper portion of each bookend engages a book and additional force is simultaneously applied to each bookend, the front wall of each bookend will move into engagement with the book and, in so doing, will move upwardly together with the front portion of the bookend. The top portion of each bookend will simultaneously be rotated or tilted rearwardly due to the lateral or rearward pressure exerted by the upper portion of the book on the top portion of each bookend. This lateral pressure will of course be created by the greater width of the upper portion of the book.

When the front wall of each bookend moves into engagement with a book, the top portion of each bookend will be rotated or tilted rearwardly due to the lateral pressure of the book which in turn will lift the front wall and front portion of each bookend upwardly and move the rear portion of each bookend downwardly. The front wall of each bookend will of course move into engagement with the book when force is simultaneously applied by hand to the bottom portion of each bookend. With the force being so applied, the bottom portion of the book will undergo greater compression than the upper portion thereof, which in turn will further increase the lateral pressure exerted by the upper portion of the book on the top portions of the bookends and will thus further contribute to the rearward rotation or tilting of the upper portions of the bookends.

The upward movement of the front portion of each bookend will move the front portion of each dovetail into a firm locking engagement with the corresponding walls of the dovetail groove and the downward movement of the rear portion of each bookend will move the rear portion of each bottom wall of each bookend into tight locking engagement with the top surface or wall of the base member. Such movement of the bookends when engaging the books will automatically self-lock or firmly affix the bookends to the base member and the bookends will then firmly hold one or more books in an upright position on the base member.

Two approaches can be employed to move the bookends out of engagement with a book. In the first approach, the bottom portion of each bookend is grasped by hand and force is applied to each bookend to move it outwardly of the base member and away from the book, with the force again applied substantially parallel to the dovetail groove in the base member. The first approach can be successfully employed when the bookends are not tightly locked to the base member.

The second approach is employed when the bookends are tightly locked to the base member and cannot be moved out of engagement with a book when force is applied by hand to the bottom portions of the bookends. In the second approach, the top portion of each bookend is grasped by hand and rotated or tilted inwardly of the base member to further compress the upper portion of the book. The top portion of each bookend is then simultaneously moved downwardly to unlock each bookend from the base member. The downward movement of the front portion of each bookend will move the dovetails out of tight engagement with the dovetail groove and will move the rear portions of the bottom wall of each bookend out of tight engagement with the top surface of the base member. When unlocked, the top or bottom portions of each bookend can easily be grasped by hand and, with force being applied to the top or bottom portions substantially parallel to the dovetail groove, the bookends can then easily be moved outwardly of the base member out of engagement with the book. The dovetails will now slide freely within the dovetail groove.

One object of the invention is to utilize a dovetail and dovetail groove arrangement to provide a rack that is adjustable and self-locking.

Another object of the invention is to provide an adjustable and self-locking rack which is extremely simple in construction.

Another object of the invention is to provide an adjustable and self-locking rack which can be easily and cheaply fabricated or manufactured.

Still another object of the invention is to provide an adjustable and self-locking rack that can easily be assembled and disassembled.

These together with other objects and advantages of the book rack, which will become subsequently apparent, reside in the details of the structure and operation thereof as more fully hereinafter are described and claimed, reference being had to the accompanying drawings forming a part hereof.

Description of the Preferred Embodiments of the Invention

Figure 1:
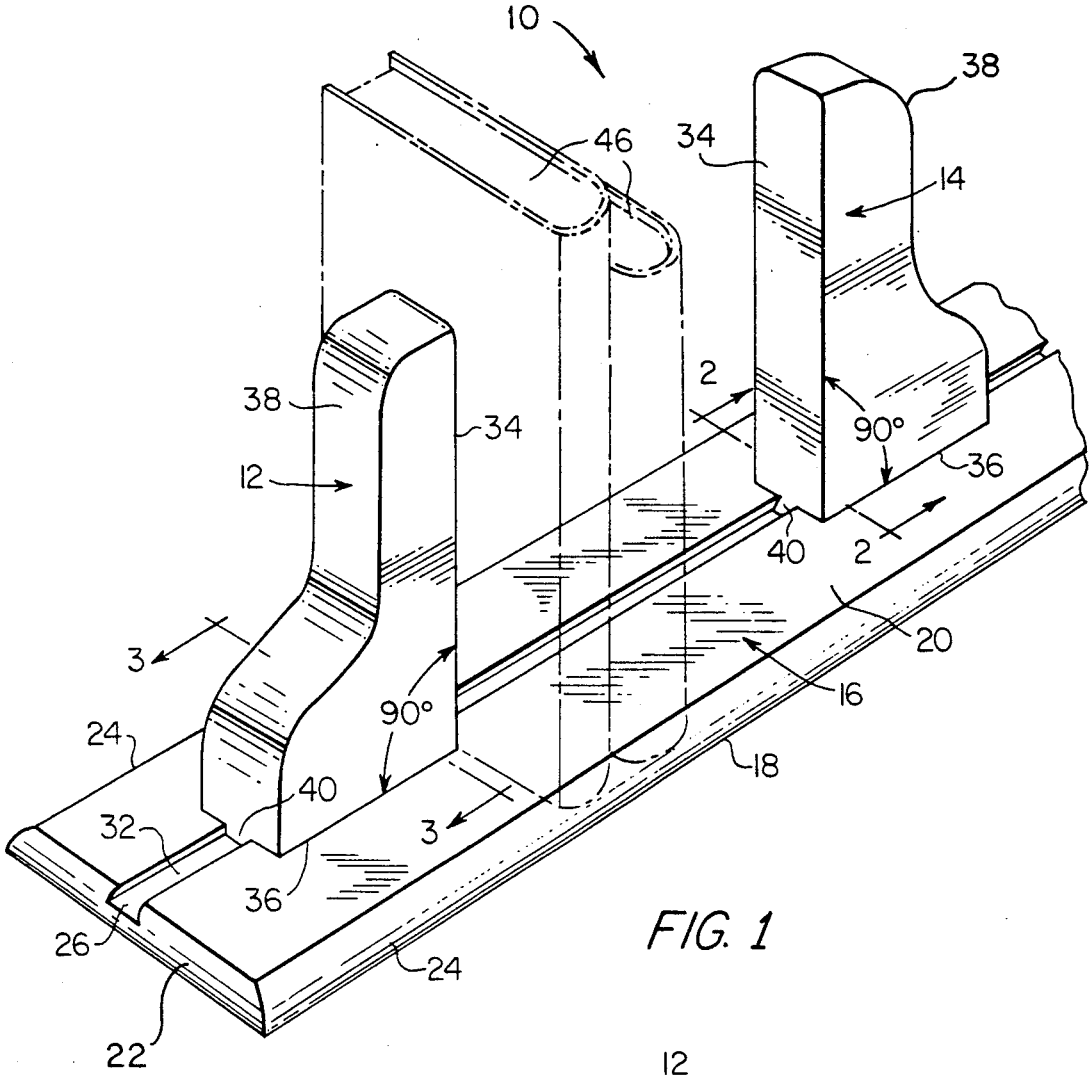
FIG. 1 is a perspective view of an adjustable and self-locking book rack or book support of the present invention illustrating the best mode of construction and operation of its components according to one of several preferred embodiments.

Referring now to the FIGS. 1-4 of the drawings which show one preferred embodiment of the invention, and, wherein like reference numerals refer to like parts throughout, FIG. 1 shows a book rack or book support 10. The rack 10 includes a pair of substantially identical bookends 12, 14 which are carried by or slidably mounted on a planar base member 16. Base member 16 includes a bottom wall 18 and a top wall or top surface 20. Base member also includes a pair of end walls 22, 22 and a pair of side walls 24, 24. The bottom wall 18 is adapted to support the book rack on a table or the like, and the base member is in this instance rectangular in shape and has a length for greater than its width.

The base member has a longitudinally extending dovetail groove 26 therein which extends the entire length of the base member and terminates in the end walls 22, 22 of the base member. The longitudinally extending groove 26 is defined by a bottom wall 28, a pair of sloping side walls 30, 30 and terminates in the top wall 20 of the base member in a longitudinally extending slot 32. The longitudinally extending groove 26 is formed in the base member intermediate the bottom wall 18 and the top wall 20.

Figure 3:
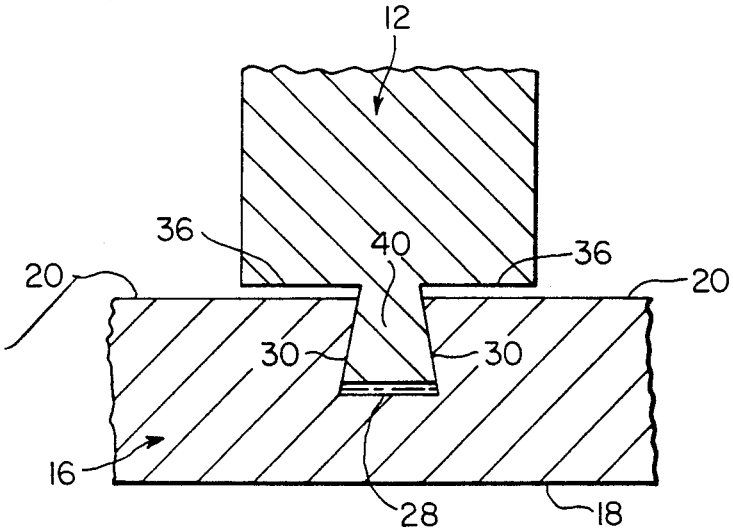
FIG. 3 is a section taken along lines 3—3 of FIG. 1.
Figure 2:
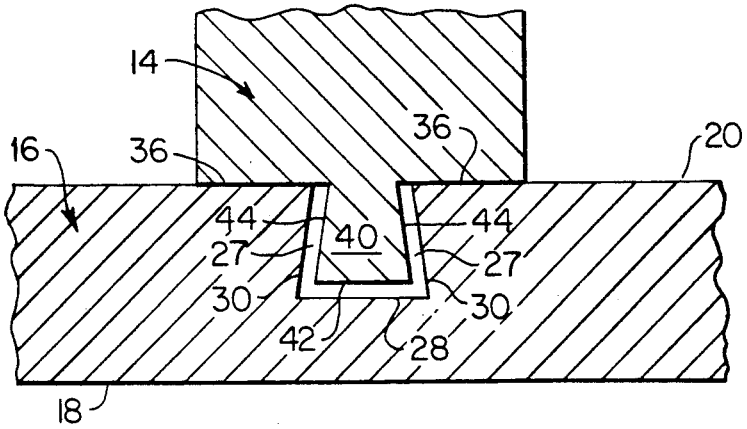
FIG. 2 is a section taken along line 2—2 of FIG. 1.
Figure 4:
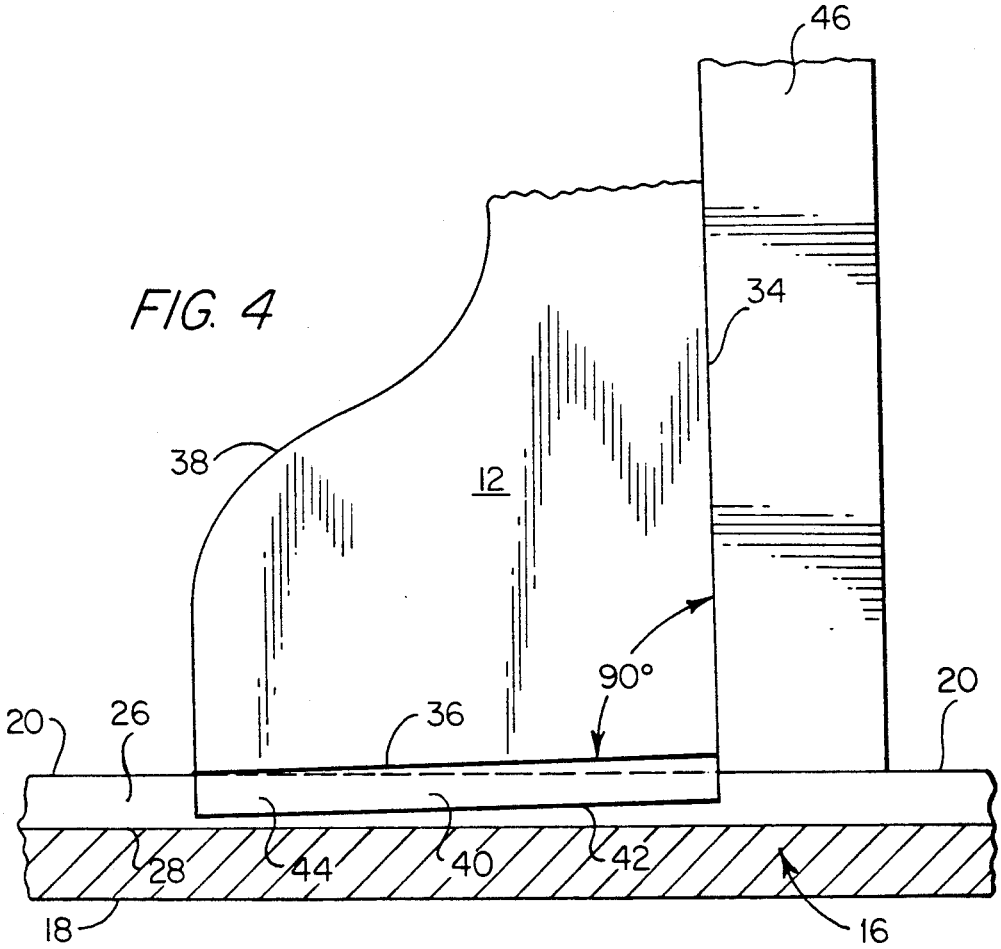
FIG. 4 is a cutaway side elevation of the bookend on the left side of FIG. 1 illustrating the position of the bookend and its depending dovetail when the bookend is in the locked position and firmly engaging a book.

As mentioned above, the base member slidably carries two bookends 12, 14 each of which has a front wall 34, a bottom wall 36, and an end wall 38. As best shown in FIGS. 2, 3 and 4, each bookend has depending from the bottom wall 36 thereof a dovetail 40 with the dovetail depending fron the bottom wall 36 at the approximate mid-point of each bottom wall and dividing each bottom wall into two parts or shoulders 36, 36. The dovetail 40 on the bottom wall 36 of each bookend extends the length of the bottom wall 36 of each bookend and the two shoulders 36, 36 are adapted to be slidably carried or received on the top wall 20 of the base member 16. As best shown in FIG., each dovetail 40 is defined by a bottom wall 42 and two sloping side walls 44, 44. Each dovetail 40 is adapted to be slidably received within the longitudinally extending dovetail groove 26, and the dovetail 40 in combination with the two shoulders 36, 36 on the bottom wall 36 of each bookend holds the two bookends in an upright position on the base member.

The dovetail groove 26 and the dovetail 40 or both are dimensioned so that there is a slight clearance 27 between the walls of the groove and the walls of the dovetail. This clearance 27 is critical to the self-locking function of the bookends and also determines the ease with which the bookends may be slidably moved on the base member 16. If the clearance 27 between the dovetails 40 and dovetail groove 26 is too small or too tight, the bookends cannot easily be moved by hand on the base member into and out of engagement with books.

In most instances, the clearance between the dovetails 40 and the groove 26 should be dimensioned so that the bookends can be slidably moved with ease by hand on the base member while at the same time the bookends offer a slight resistance to movement and do not wobble when moved back and forth on the base member. If the clearance between the dovetails 40 and the groove 26 is increased to the point where the bookends wobble, the greater clearance will afford a tighter lock between the bookends and the base member inasmuch as the increased clearance will permit a greater upward movement of the front portions of the bookends as the bookends are moved into the locked position. This greater upward movement will move the walls 44, 44 of the dovetails into a tighter locking engagement with the corresponding walls 30, 30 of the groove 26.

FIG. 2 best illustrates this clearance 27 between the groove 26 and the dovetail 40 and, for the purposes of illustration and the application of references numerals, the clearance is greatly exaggerated. As exaggerated, the clearance would preclude the bookends from self-locking to the base member inasmuch as the walls 44, 44 of the dovetails would not move into tight locking engagement with the corresponding walls 30, 30 of the groove 26 as the front portions of the bookends move upwardly. In actual construction, the clearance would of course be much smaller or tighter.

FIG. 3 shows the bookend 12 in a self-locking position and illustrates how a slight clearance between the dovetail groove 26 and the dovetail 40 permits a small or predetermined upward movement of the front portion of the bookend to move the walls 44, 44 of the dovetail 40 into tight locking engagement with the tapered walls 30, 30 of the dovetail groove 26 to thereby move the bookend into a tight locking engagement with the base member, as will be discussed more fully hereinafter in connection with the use and operation of the book rack.

FIG. 4 shows the bookend 12 in the locked position and illustrates the clearance between the bottom wall 42 of the dovetail 40 and the bottom wall 28 of the dovetail groove. This clearance is critical to the proper functioning of the bookends and, for the purpose of emphasis, is slightly exaggerated in FIG. 4. The dovetail and dovetail groove must be dimensioned so that the bottom wall 42 of the dovetail 40 will not engage the bottom wall 26 of the dovetail groove when the bookend 12 is either in the locked or unlocked positions.

If the bottom wall 42 of the dovetail 40 engages the bottom wall 26 of the groove when the bookend is in the unlocked position, (dovetail is too long), the shoulders 36, 36 on the bottom wall 36 of the bookend will not simultaneously and slidably engage the top wall 20 of the base member and the bookend 12 will not stand upright on the base member 16 (bookend will be leaning or canted and will wobble). Moreover, if the dovetail 40 is too long and engages the bottom wall 28 of the groove and the clearance between the dovetail and the groove is too small, the excess length of the dovetail 40 will move or lift the walls 44, 44 of the dovetail into engagement with the corresponding walls 30, 30 of the groove 26 which in turn will preclude the bookends from being easily and slidably moved back and forth on the base member. If the bottom wall 42 of the dovetail 40 engages the bottom wall 28 of the groove when the bookend is in the locked position (dovetail is too long), the rear portion of the bottom wall 36 of the bookend 12 will not move into tight locking engagement with the top wall 20 of the base member when the bookend is tilted or rotated rearwardly.

As best shown in FIGS. 1 and 4, the front wall 34 of each bookend intersects the bottom wall 36 thereof and defines an angle of intersection in this instance of 90°. While such angle may be greater than 90°, it should in most instances or applications be at least 90° or at least slightly less than 90°, such as 89½° to insure that the bookends will automatically lock to the base member. An angle of 90° will in almost all instances provide self-locking between the bookends and the base member. An angle of 89° or 88° will not in all instances provide self-locking inasmuch as the self-locking will depend on the configuration and composition of the subject matter carried or positioned between the bookends. Consequently, in most instances and from a practical or operability standpoint, the angle of intersection should be substantially 90° or greater. When the angle of intersection is greater than 90°, the greater angle will result in a tighter and more rigid lock between the bookends and the base member, as will also be more fully discussed hereinafter.

The longitudinally extending groove 26 in this preferred embodiment of the invention is formed in the base member with a standard or commonly available dovetail groove cutter and the bottom wall of the groove has a width of ½ inch. The dovetails 40 depending from the bottom walls of the bookends 12, 14 are also formed with a standard or commonly available dovetail cutter which cuts or dimensions the dovetail so that it is can be slidably received within the dovetail groove. To facilitate ease of slidable movement of the dovetails 40 within the dovetail groove, the surfaces or walls of the dovetail and the groove can be sanded, filed or slightly smoothed with steel wool.

In this preferred embodiment of the invention, the rack 10 is made entirely of wood. The clearances or tolerances between the walls of the dovetails 40 and the dovetail groove 26 are approximately 1/64 inch. The length of the bottom wall 36 of each bookend is 4 inches and the length or height of each front wall 34 is 9¾ inches. The thickness of each bookend is 1½ inches.

For best results, the length of the bottom wall 36 should not exceed 4 inches and, in most applications involving a single pair of bookends, should fall within the range of 2 to 4 inches. This range will insure that the clearance between the dovetail and the dovetail grooves will permit sufficient upward and tilting movement of the bookends to enable the bookends to be securely locked to the base member. If the length of the bottom wall of each bookend is greater than 4 inches, the tilting or rotation of the top portion of each bookend will result in the bottom wall of the rear portion of each bookend moving into engagement with the top surface of the base member before the dovetails on the bottom walls of the bookends can move into tight locking engagement with the corresponding walls of the dovetail groove. In other words, each bookend will be locked only partially to the base member and only by the rear portions of the bottom walls of the bookends moving into engagement with the top surface of the base member. This engagement between the rear portion of the bottom wall of each book and the top wall of the base member will thus prevent any further upward movement of the front portion of each bookend or any further rotation or tilting movement of the top portion of each bookend.

FIG. 1 shows the bookend 12 in a locked position and bookend 14 in an unlocked position on the base member 16. Normally, the bookends would either both be in the unlocked position (not in use) or would both be in the locked position (in use and holding one or more books on the base member). FIG. 1 shows the bookends 12, 14 in different positions solely to illustrate the invention and, more particularly, to clearly show the structure and function of the bookends in both the locked and unlocked positions.

To use the book rack, the dovetails 40 on the bottom walls 36 of the bookends 12, 14 are first inserted into the dovetail groove 26 in the base member 16 from opposite ends of the base member. Since the groove 26 terminates in the end walls 22, 22 of the base member, the groove 26 can be easily entered or accessed by the dovetails 40. Each bookend is then simultaneously manually moved inwardly from the ends of the base member toward engagement with one or more books 46 positioned on the base member. In moving the bookends on the base member, the bottom portion of each bookend is grasped by hand and force is applied to the bottom portion to move each bookend inwardly of the base member toward engagement with a book, with the force being applied substantially parallel to the dovetail groove in the base member.

As the front wall 34 of each bookend moves toward engagement with a book 46, the top portion of each bookend will first engage the upper portion of the book. This happens because the upper portion of the book will be flaired outwardly or will be greater in width than the bottom portion of the book. Also, when a plurality of books are placed on the base member in an upright position, prior to being held or supported by the bookends, the books will usually will not be standing in a vertical position and will thus be leaning at an angle toward the front wall or face of each bookend. When the upper portion of each bookend engages a book and additional force is simultaneously applied to each bookend, the front wall 34 of each bookend will move into engagement with the book and, in so doing, will move upwardly together with the front portion of the bookend. The top portion of each bookend will simultaneously be rotated or tilted rearwardly due to the lateral or rearward pressure exerted by the upper portion of the book on the top portion of each bookend. This lateral pressure will of course be created by the greater width of the upper portion of the book.

When the front wall 34 of each bookend moves into engagement with a book 46, the top portion of each bookend will be rotated or tilted rearwardly due to the lateral pressure of the book which in turn will lift the front wall 34 and front portion of each bookend upwardly and move the rear portion of each bookend downwardly. The front wall 34 of each bookend will simultaneously move into engagement with the book when force is simultaneously applied by hand to the bottom portion of each bookend. With the force being so applied, the bottom portion of the book will undergo greater compression than the upper portion thereof, which in turn will further increase the lateral pressure exerted by the upper portion of the book on the top portions of the bookends and will thus further contribute to the rearward rotation or tilting of the upper portions of the bookends.

The upward movement of the front portion of each bookend 12, 14 will move the front portion of each dovetail 40 into a firm locking engagement with the corresponding walls of the dovetail groove (FIG. 3), and the downward movement of the rear portion of each bookend will move the rear portion of each bottom wall 36 of each bookend into tight locking engagement with the top surface or wall 20 of the base member (FIG. 4). Such movement of the bookends 12, 14 when engaging the books will automatically self-lock or firmly affix the bookends to the base member 16 and the bookends will then firmly hold one or more books in an upright position on the base member.

Two approaches can be employed to move the locked bookends 12, 14 out of engagement with a book. In the first approach, the bottom portion of each bookend is grasped by hand and force is applied to each bookend to move it outwardly of the base member and away from the book, with the force again applied substantially parallel to the dovetail groove in the base member.

The second approach is employed when the bookends 12, 14 are tightly locked to the base member 16 and cannot be moved out of engagement with a book 46 when force is applied by hand to the bottom portions of the bookends. In the second approach, the top portion of each bookend is grasped by hand and rotated or tilted inwardly of the base member to further compress the upper portion of the book. The top portion of each bookend is then simultaneously moved downwardly to unlock each bookend from the base member. The downward movement of the front portion of each bookend will move the dovetails 40 out of tight engagement with the dovetail groove 26 and will move the rear portions of the bottom wall 36 of each bookend out of tight engagement with the top surface 20 of the base member. When unlocked, the top or bottom portions of each bookend can easily be grasped by hand and, with force being applied to the top or bottom portions substantially parallel to the dovetail groove 26, the bookends can then easily be moved outwardly of the base member out of engagement with the book. The dovetails 40 will now slide freely within the dovetail groove 26.

Figure 5:
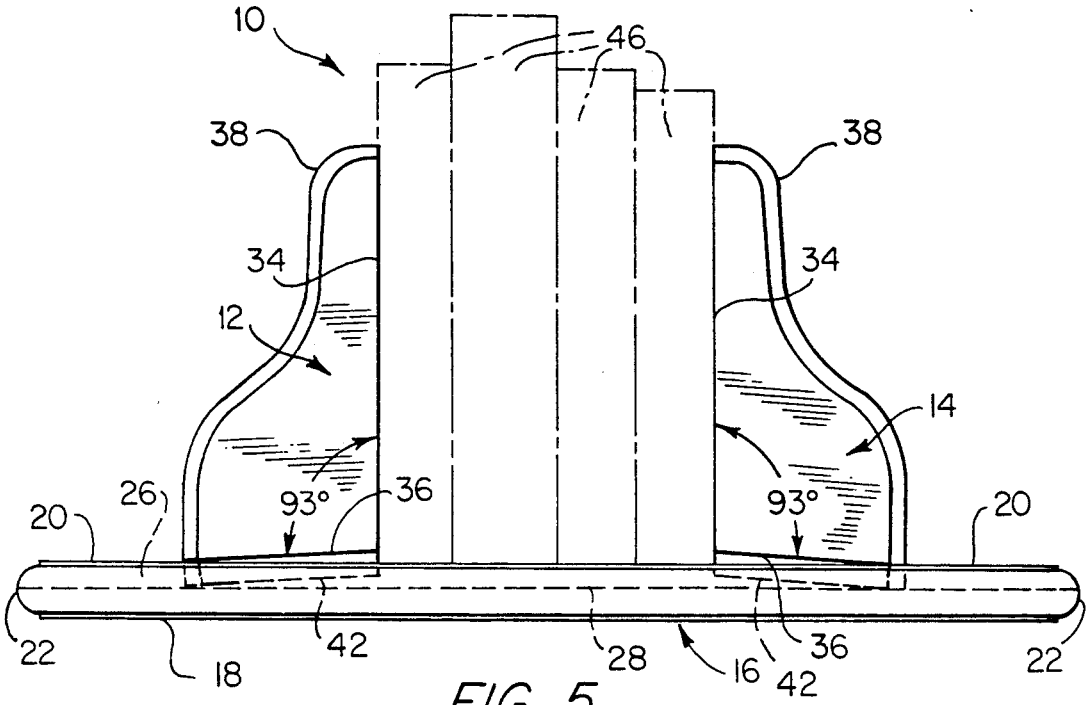
FIG. 5 is an side elevation of another embodiment of the book rack showing the the two bookends having tapered front faces and in the locked position.
Figure 6:
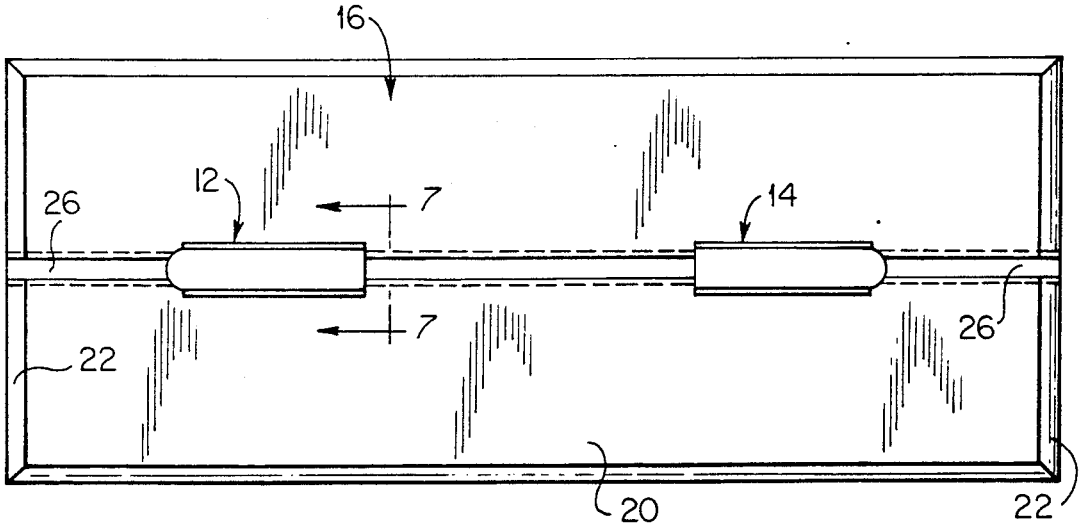
FIG. 6 is a top plan of the book suport of FIG. 5.
Figure 7:
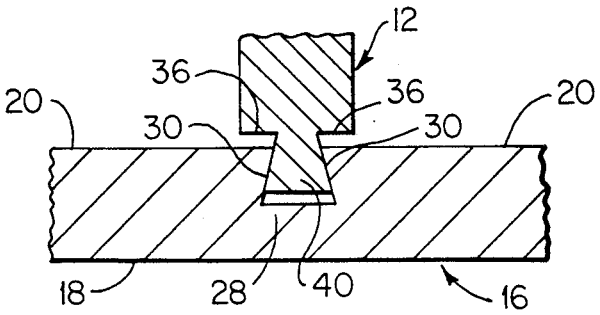
FIG. 7 is an section taken along line 7—7 of FIG. 6.

FIGS. 5–7 show another preferred embodiment of the invention wherein the same reference numerals are used throughout and wherein the only basic difference between this embodiment and the embodiment of FIGS. 1–4 is that the angle of intersection between the front wall 34 and the bottom wall 36 of each bookend 12, 14 is 93° rather than 90°. In construction, the front wall 34 of each bookend is tapered or bevelled inwardly from top to bottom to provide the increased angle of intersection. Otherwise, the basic structure of the two embodiments is identical. FIGS. 5–7 show the bookends 12, 14 in locking engagement with the base menber 16. The front wall 34 of each bookend along its entire length is in engagement with a book 46. The front portion of each dovetail 40 (FIG. 7) is in tight locking engagement with the sloping walls 30, 30 of the groove 26 and the rear portion of the bottom wall 36 of each bookend is in tight locking engagement with the top wall 20 of the base member.

Increasing the angle of intersection to 93° provides a tighter lock between the bookends 12, 14 and the base member 16. Tapering the front wall 34 of each bookend and increasing the angle of intersection requires that the bottom wall 36 of each bookend move a greater distance on the base member 16 when moving from the unlocked to the locked position to move front wall 34 into engagement with a book. This additional movement of the bottom wall 36 also results in a greater upward movement of the front wall 34 and the front portion of the bookend. This greater upward movement also results in a greater rearward rotation or tilting of the top portion of each bookend. This additional upward movement will move the front portion of each dovetail 40 into a tighter locking engagement with the corresponding walls 30, 30 of the dovetail groove 26 (FIG. 7). The additional rotation or tilting of the top portion of each bookend will result in the back portion of the bottom wall of each bookend moving into a tighter locking engaement with the top wall 20 of the base member. Otherwise, the function of the two embodiments of the invention is identical. When the bookends are in the locked position and it is desired to unlock the bookends and move them out of engagement with a book, the second approach hereinbefore discussed should be employed.

The book rack in this embodiment shown in FIGS. 5–7 is also made of wood and the bookends 12, 14 are smaller than in the embodiment of the FIGS. 1–4. The bottom wall 36 of each bookend has a length of $3\frac{7}{8}$ inches and the front wall of each bookend has a length of $7\frac{7}{8}$ inches. Each bookend has a thickness of 1 inch. The bottom wall 28 of the dovetail groove 26 has a width of $\frac{1}{2}$ inch. The dovetail and the dovetail groove are cut or formed in the same manner as in the embodiment of FIGS. 1–4 and the tolerances or clearances between the dovetails and the dovetail groove are the same.

Figure 8:
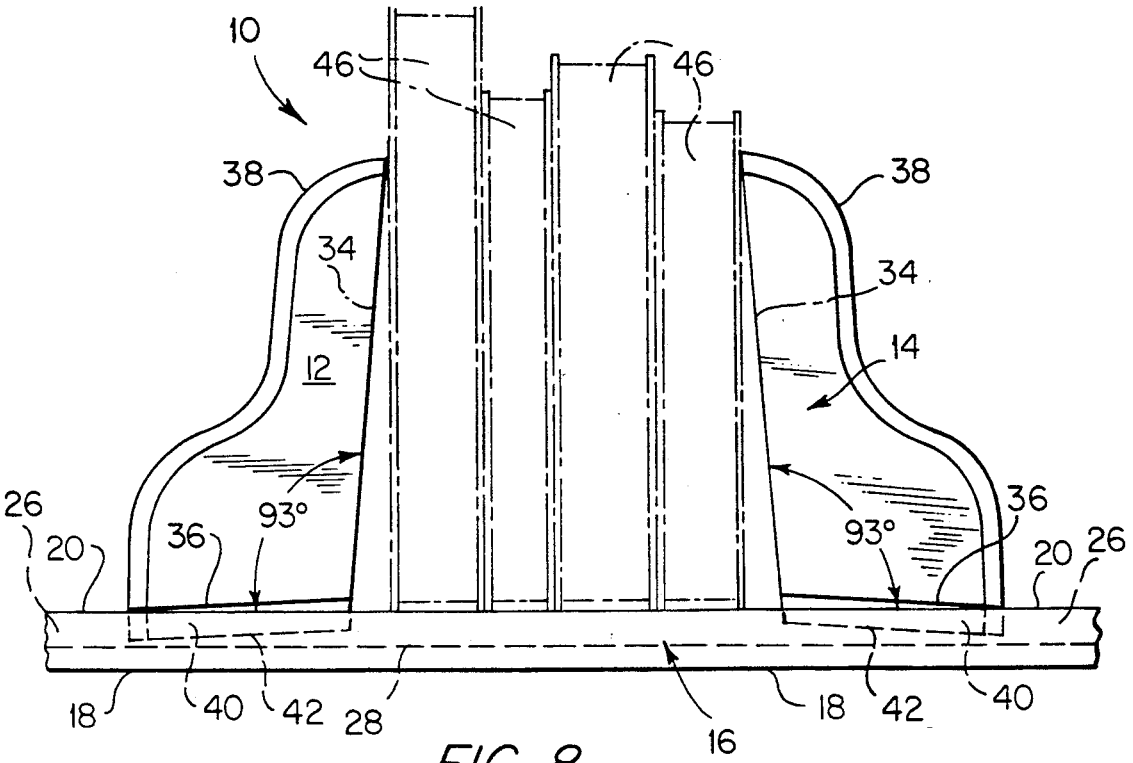
FIG. 8 is a side elevation of another embodiment of the invention wherein the bottom wall of each bookend is tapered and the top portions of the bookends are in engagement with the upper portions of the books just prior to being moved from the unlocked into the locked position.
Figure 9:
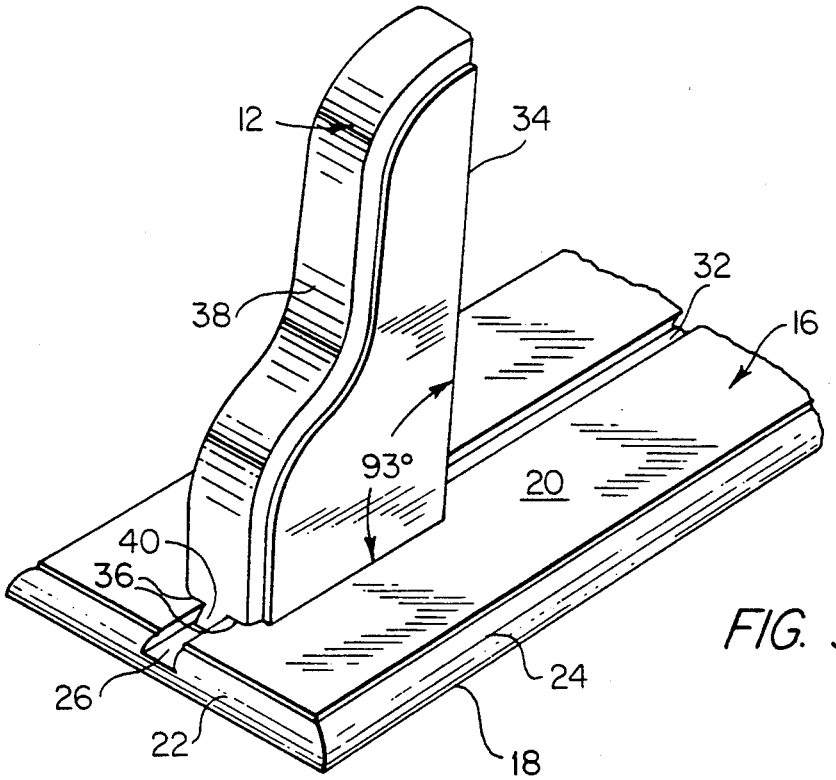
FIG. 9 is a partial perspective view of the bookend on the left side in FIG. 8 showing the bookend in an unlocked position and illustrating the dovetail being slidably received within the dovetail groove in the base member.

FIGS. 8–9 show another preferred embodiment of the invention wherein the same reference numerals are used throughout and the wherein the angle of intersection is also 93°. The increased angle of intersection in this emnbodiment of the invention is formed by tapering or bevelling the bottom wall 36 of each bookend 12, 14 from rear to front. The bookends are shown in FIG. 8 in the unlocked position with the top portions only of the front walls 34 of the bookends in engagement with a book.

The book rack of this embodiment is also made of wood. The length of the bottom wall 36 of each bookend 12, 14 is $2\frac{3}{4}$ inches and the length of the front wall 34 is $7\frac{1}{4}$ inches. The thickness of each bookend is $\frac{3}{4}$ inches. The rack in this embodiment is otherwise identical is structure and function to the rack shown FIGS. 5–7.

Figure 10:
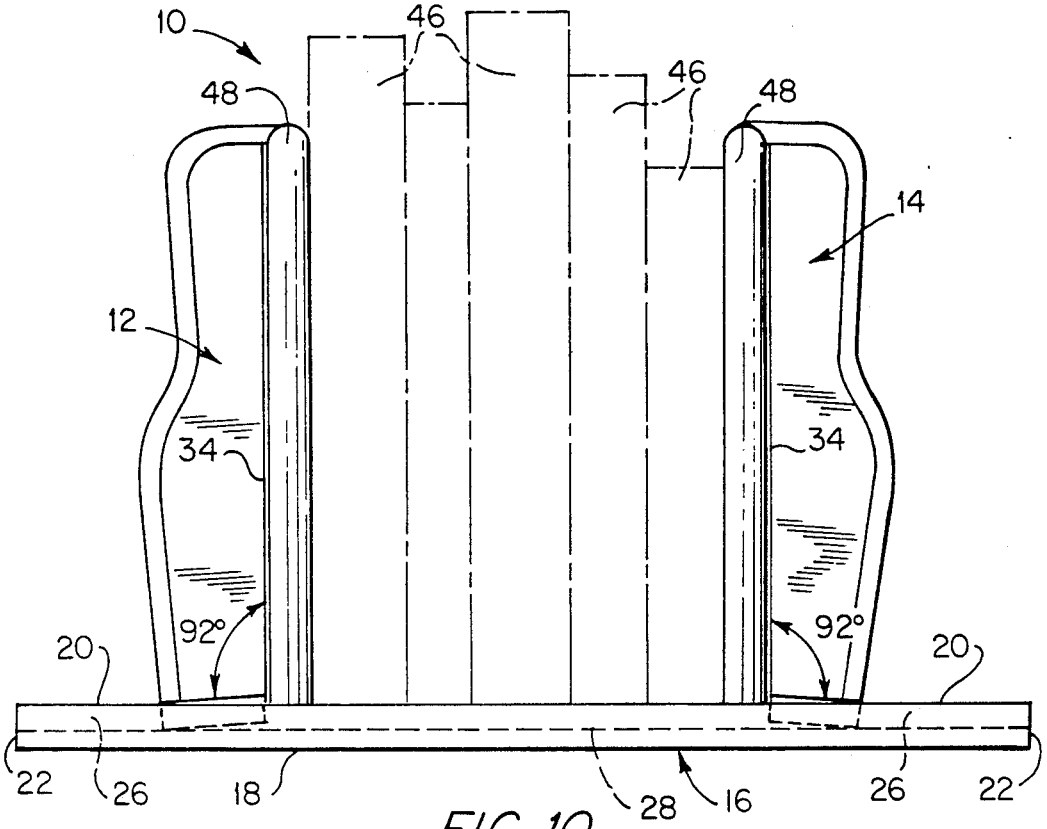
FIG. 10 is side elevation of another enbodiment of the invention wherein the front wall of each bookend is tapered and carries a panel member to increase the surface area of the front wall that engages a book.
Figure 11:
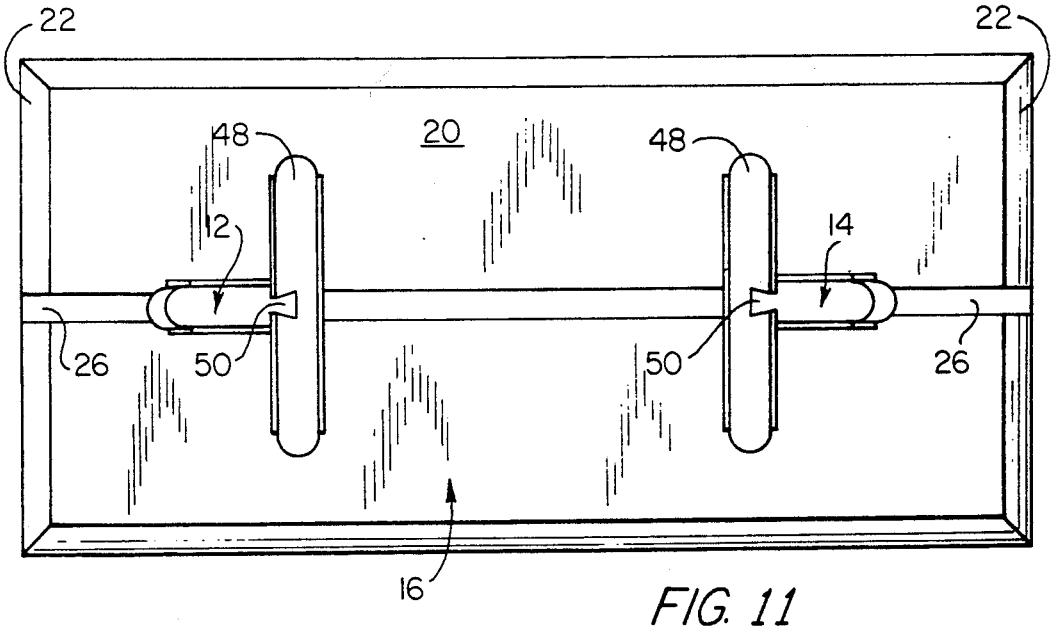
FIG. 11 is a top plan view of the book rack of FIG. 10.
Figure 12:
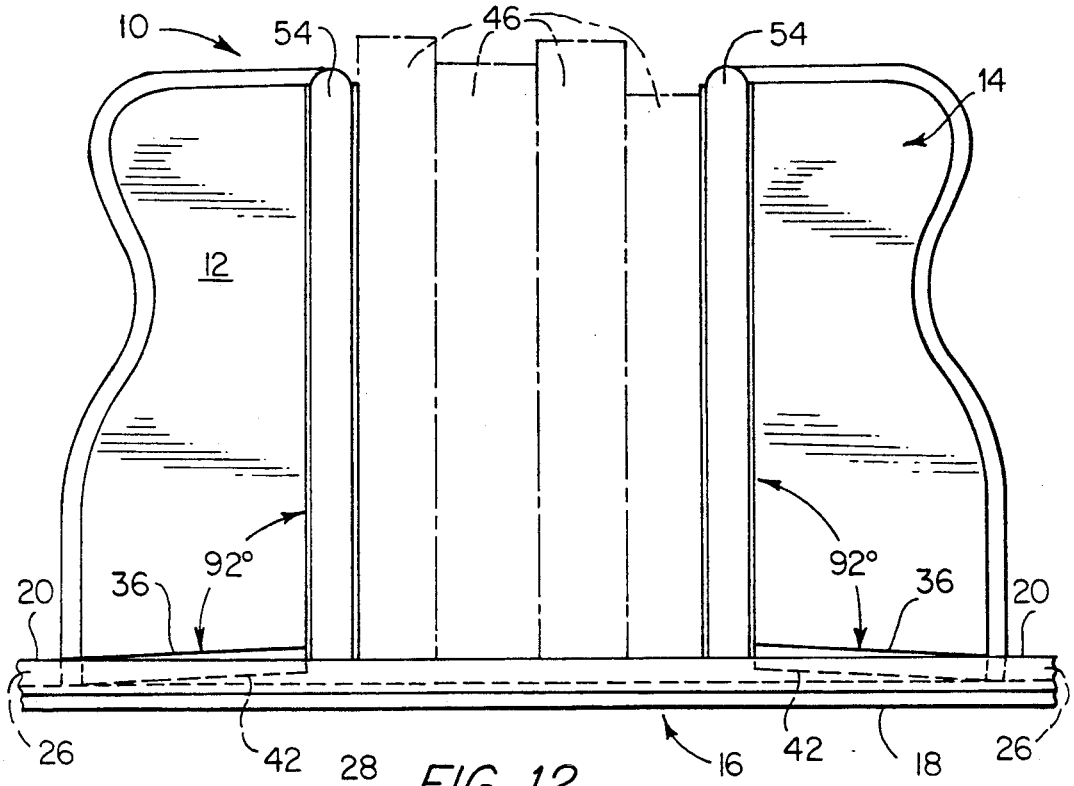
FIG. 12 is a side elevation of another embodiment of the invention wherein dual bookends are slidably received within two parallel dovetail grooves and wherein the front walls of the bookends carry panels for increasing the surface area of the front walls.
Figure 13:
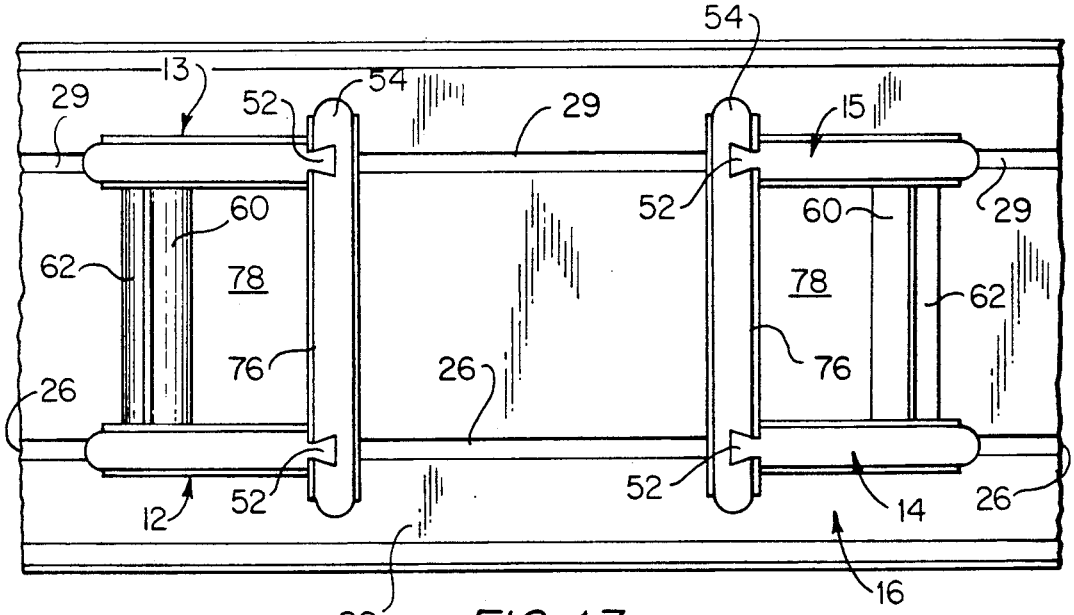
FIG. 13 is a top plan view of the book rack of FIG. 12.
Figure 14:
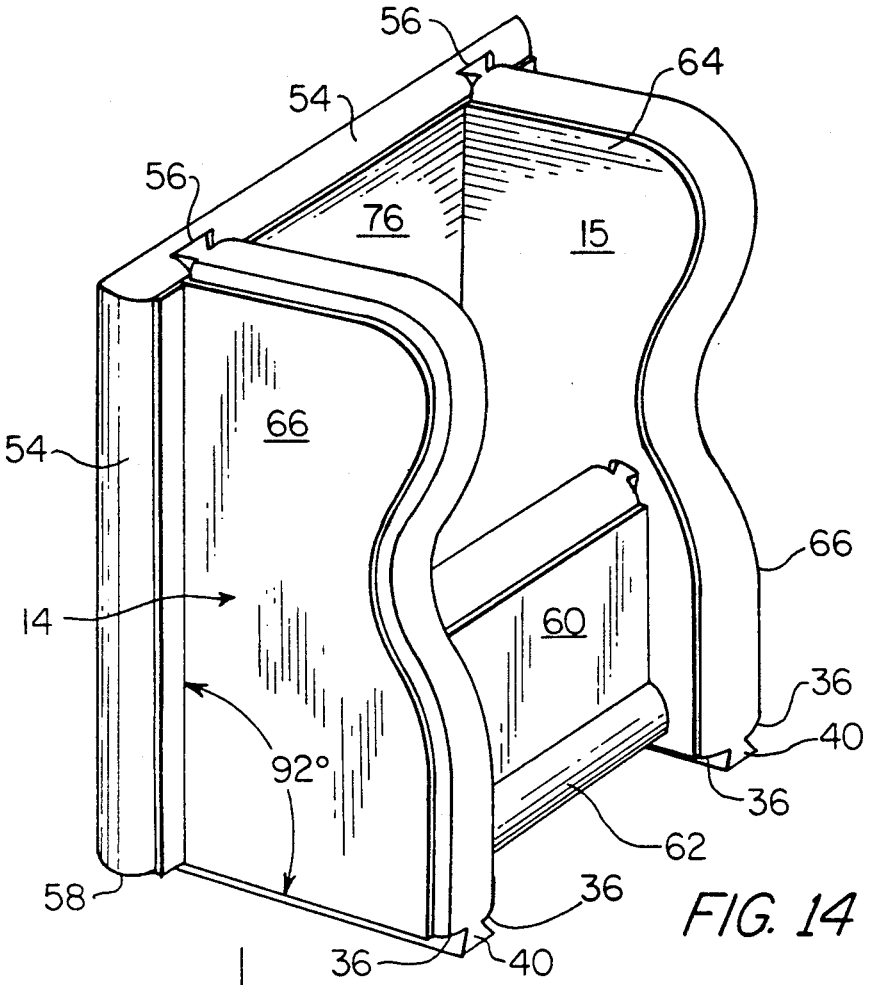
FIG. 14 is a perspective view of one of the dual bookends removed from the base member and illustrating the construction for rigidly connecting the two bookends.
Figure 15:
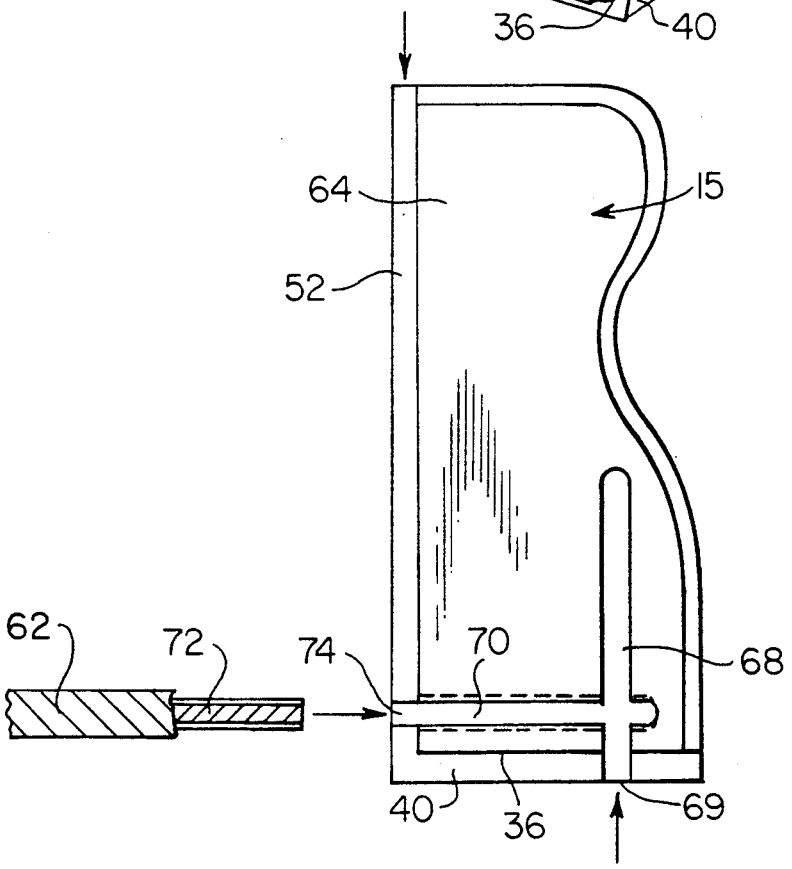
FIG. 15 is a side elevation of the bookend on the right side in FIG. 14 in an unassembled position and illustrating the structure or components for rigidly securing the two bookends in assembled engagement.

FIGS. 10–11 show still another preferred embodiment of the invention wherein like reference numerals are used throughout and wherein the angle of intersection is 92°. The front wall of each bookend is sloped or tapered to provide the angle of intersection between the front wall and bottom wall of 92°. The structure of the rack in this embodiment differs from the structure of the previous embodiments in that the front wall 34 of each bookend 12, 14 carries a panel or planar member 48 to increase the surface area of the bookend that engages a book 46. The front wall of each bookend is formed with a dovetail 50 thereon extending the length thereof. The panel 48 is formed with a corresponding longitudinally extending dovetail groove therein (no reference numeral) extending the length thereof. The dovetail 50 is slidably received in the dovetail groove in each panel 48 to hold each panel 48 in engagement with each bookend. In operation or use of the rack, the bottom wall of each bookend and each panel are slidably received or carried on the top wall 20 of the base member 16. Each bookend and the panel carried thereon move together or in unision.

Other than the panel and dovetail and dovetail groove arrangement for securing the panel to each bookend, the book rack of this embodiment is otherwise identical in basic structure and function to the book racks of the two previous embodiments. The book rack in this embodiment is also made of wood. The length of the bottom wall (no reference numeral) of each bookend is 2 5/16 inches and the length of each front wall is 10⅛ inches. The thickness of each bookend is ¾ inches. The panels 48 make the rack especially well adapted for holding magazines, newspapers, file folders, catalogues, envelopes and other objects that lack a hard back or cover.

FIGS. 12–15 show still another preferred embodiment of the invention wherein like reference numerals are used for the most part throughout and wherein dual bookends or bookends with dovetails on the bottom walls thereof are connected together in pairs of two and are mounted on a base member for slidable movement of the dovetails within a pair of parallel dovetail grooves extending longitudinally of the base member. Dual bookends 12, 13 (FIG. 13) form one pair of bookends and dual bookends 14, 15 form the other pair. The bookends in each pair have a dovetail 40 depending from the bottom walls 36 thereof at the approximate mid-point of each bottom wall and the dovetail 40 divides each bottom wall into two shoulders 36, 36 which are slidably carried on the top wall 20 of the base member 16.

The dovetails 40 on the bottom wall of each bookend are slidably received in a pair of spaced and parallel grooves 26, 29 formed in the base member 15 and extending the length of the base member. The grooves 26, 29 terminate in the end walls (not shown) of the base member 16, as in the previous embodiments of the invention. Dovetails 40 on bookends 12, 14 are slidably received in groove 26, and dovetails 40 on bookends 13, 15 are slidably received in groove 29.

The dovetails 40 and the dovetail grooves 26, 29 are formed and shaped as in the previous embodiments of the invention with the same dimensions and same clearances that will permit the pairs of bookends to move into locking engagement with the base member or to function in the same manner as the single pair of bookends in the previous embodiments. The angle of intersection in this embodiment is 92°.

The front wall 34 of each bookend is formed with a dovetail 52 thereon extending the length thereof. The dovetails 52 on each pair of bookends are slidably received in pairs of spaced and parallel dovetail grooves 56 formed in a panel or planar member 54 carried on the front walls 34, 34 of each pair of bookends. The dovetail grooves 56 extend the length of the panel 54 and the panel increases the surface area of each pair of bookends that engages a book. The panels also firmly connect or unite the front portions of each pair of bookends so that the bookends of the pair move in unision when the dovetails move in the dovetail grooves and the pairs of bookends move into an out of engagement with a book. The bottom 58 of each panel 54 is slidably carried on the top wall of the base member 16 along with the bottom wall 36 of the bookends.

The rear and bottom portions of each pair of bookends are firmly connected or united by brackets or brace members 60, 62. The brace member 60 has dovetails (no reference numerals) formed on opposite ends thereof and the dovetails are slidably received in opposed dovetail grooves 68 (only one shown in FIG. 15) formed in the lower rear portion of each pair of bookends. The dovetail grooves 68 are formed in the bookends intermediate the inner walls 64 and the outer walls 66 of each bookend and terminate in a slot (no reference numeral) on the inner wall 64 of each bookend. The opposed grooves 68 extend vertically of the bookends and terminate at the lower end in an opening 69 in the bottom wall of each dovetail 40 formed on the bottom wall of each bookend. This opening provides access or entry for the dovetails on the opposite ends of brace member 60 to be received in the dovetail grooves 68. Brace member 60 fits snuggly between the inner walls 64, 64 of each pair of bookends and is dimensioned so that when positioned in the dovetail grooves 68, it engages lower brace member 62 and also engages the inner face 76 of panel 54.

Brace member 62 firmly connects or unites the bottom portions of each pair of bookends. Brace member 62 has dovetails 72 (only one shown in the step-down section in FIG. 15) on opposite ends thereof which are slidably received in opposed dovetail grooves 70 (only one shown in FIG. 15) formed in the bottom portions in each pair of bookends. Grooves 70 extend substantially parallel to bottom walls 36 of each pair of bookends and each groove terminates at one end in an opening 74 (only one shown) in the dovetail 52 on the front wall of each bookend. The openings 74 provide entry or access for the dovetails 72 on opposite ends of brace member 62 to be slidably received in the dovetails grooves 70. When brace member 62 is positioned within dovetail grooves 70, it fits underneath the bottom wall (no reference numeral) of brace member 60 and the two brace members are in engagement. The two brace members 60, 62 in combination with the panel 54 carried on the front walls of each pair of bookends rigidly connect or unite the pairs of bookends which will move in unision without the dovetails 40 binding or yawing in the pair of dovetail grooves 26, 29 when the pairs of bookends are moved on the base member 16 into and out of engagement with a book. The two brace members 60, 62 in combination with the inner walls 64, 64 of the pairs of bookends and the back wall 76 of the panel 54 form a receptacle 78 in each pair of bookends which serves as a storage means for holding office supplies, flowers, figurines, small books, etc.

The dual bookends of this embodiment operate or function in the same manner as the single pair of bookends in the three previous embodiments of the invention. The pairs of bookends in this embodiment lock tighter to the base member inasmuch as there will be four bookends locked to the base member rather than two bookends as in a single pair.

The rack in this embodiment of the invention is also made of wood. The bottom wall of each bookend has a length of 4⅛ inches and the front wall has a length of 10 inches. Each bookend in each pair has a thickness of ¾ inches.

While the preferred embodiments of the invention as herein shown and described are made of wood, it will be appreciated that other materials such as wood composites, plastics, PLEXIGLAS TM, metals, or glass could also be employed in the construction of the rack. Moreover, while a dovetail and dovetail groove arrangement are utilized in the preferred embodiments of the rack, it will also be appreciated that other structural arrangements for operatively connecting the bookends to a base member could be employed, such as mortise and tenons taking the configuration of a ball-shaped mortise and tenon, or a T-shaped mortise and tenon.

It will be further appreciated that the first three (3) embodiments of the invention shown in FIGS. 1–4, FIGS. 5–7, and FIGS. 8–9 could readily be modified so that the front walls 34 of each pair of bookends could have a panel mounted thereon as shown in the embodiment of FIGS. 10–11. The bookends in these three embodiments could be modified in the same manner as in the rack in FIGS. 10–11 wherein the front wall 34 of each bookend is formed with a dovetail thereon and each dovetail is adapted to be slidably received in an elongated dovetail groove formed in the panel and extending the length thereof.

It will also be appreciated that the rack of the present invention could readily be made and sold in kit form for assembly by a purchaser. The dovetail and dovetail groove construction especially lends itself to kit form purchases inasmuch as the components of the rack can be easily assembled into operative form with no written instructions or a very minimum of written instructions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to as falling within the scope of the invention.

What is claimed and desired to be secured by Letters Patent is:

1. An adjustable and self-locking book rack or book support for securely holding books or the like in an upright position comprising a planar base member having side walls, end walls, and top and bottom walls, said base member having a longitudinally extending dovetail groove in the upper portion thereof intermediate said top and bottom walls, said dovetail groove extending the entire length of said base member and terminating in the two end walls thereof, said dovetail groove having a bottom wall, a pair of sloping side walls and terminating in an opening or longitudinally extending slot in the top wall of said base member, and at least a pair of bookends or book support members each having a front wall, a bottom wall and an end wall with a longitudinally extending dovetail depending from said bottom wall at the approximate mid-point thereof and adapted to be slidably received within said dovetail groove, said dovetail extending the entire length of said bottom wall and being formed integral with said bottom wall, said dovetail having sloping side walls and a bottom wall with the dovetail or groove or both being dimensioned to provide a slight clearance between the walls of the dovetail groove and the dovetail, said dovetail dividing said bottom wall of each bookend into two parts or shoulders which are slidably supported on the top wall of said base member and hold the bookends in an upright position on the top wall of said base member, said front wall and said bottom wall of each bookend intersecting and defining an angle of intersection of substantially 90°, the front wall of each bookend when moved into engagement with said books moving the front wall and the front portion of each bookend upwardly and tilting or rotating said front wall and front portion rearwardly to move the sloping side walls of the corresponding front portion of each dovetail into tight engagement with the sloping side walls of the dovetail groove and move the shoulders of the rear portion of the bottom wall of each bookend downwardly into firm engagement with the top wall of the base member to thereby move the bookends into a self-locking position to hold the books firmly together in an upright position.

2. The invention of claim 1 wherein the angle of intersection is greater than 90°.

3. The invention of claim 1 wherein the front wall of each bookend is sloped or tapered to provide an angle of intersection between the front wall and bottom wall of 93°.

4. The invention of claim 1 wherein the bottom wall of each bookend is sloped or tapered to provide an angle of intersection between the front wall and bottom wall of 93°.

5. The invention of claim 1 wherein a panel is attached or carried on the front wall of each bookend to increase the surface area of the bookend that engages a book.

6. The invention of claim 5 wherein the front wall of each bookend is formed with a dovetail extending from the approximate mid-point thereof and extending the length thereof, said dovetail adapted to be slidably received in a dovetail groove in said panel extending longitudinal of said panel and extending the length thereof, said dovetail and dovetail groove holding said bookend and panel in assembled engagement.

7. The invention according to claim 3 wherein a panel is attached or carried on the front wall of each bookend to increase the surface area of the bookend that engages a book.

8. The invention according to claim 7 wherein the front wall of each bookend is formed with a dovetail extending from the approximate mid-point thereof and extending the length thereof, said dovetail adapted to be slidably received in a dovetail groove in said panel extending longitudinally of said panel and extending the length thereof, said dovetail and dovetail groove holding said bookend and panel in assembled engagement.

9. The invention of claim 4 wherein a panel is attached or carried on the front wall of each bookend to increase the surface area of the bookend that engages a book.

10. The invention of claim 9 wherein the front wall of each bookend is formed with a dovetail extending from the approximate mid-point thereof and extending the length thereof, said dovetail adapted to be slidably received in a dovetail groove in said panel extending longitudinally of said panel and extending the length thereof, said dovetail and dovetail groove holding said bookend and panel in assembled engagement.

11. The invention of claim 1 wherein the front wall of each bookend is sloped or tapered to provide an angle of intersection between the front wall and bottom wall of 92° and wherein a panel is attached or carried on the front wall of each bookend to increase the surface area of the bookend that engages a book.

12. The invention according to claim 11 wherein the front wall of each bookend is formed with a dovetail extending from the approximate mid-point thereof and extending the length thereof, said dovetail adapted to be slidably received in a dovetail groove in said panel extending longitudinally of said panel and extending the length thereof, said dovetail and dovetail groove holding said bookend and panel in assembled engagement.

13. An adjustable and self-locking book rack or book support for securely holding books or the like in an upright position comprising a planar base member having side walls, end walls, and top and bottom walls, said base member having a pair of longitudinally extending dovetail grooves spaced a predetermined distance apart in the upper portion of said base member intermediate said top and bottom walls, said dovetail grooves extending the length of said base member and terminating in the end walls thereof, each of said dovetail grooves in said pair having a bottom wall, a pair of sloping side walls, and terminating in an opening or longitudinally extending slot in the top wall of said base member, at least two bookends or book support members each comprised of a pair of bookends rigidly secured in assembled engagement so as to move toward and away from each other in said dovetail grooves in unison, each bookend of each pair having an inner wall, an outer wall, a front wall, a bottom wall and an end wall with a longitudinally extending dovetail depending from the bottom wall of each bookend in each pair at the approximate mid-point thereof and adapted to be slidably received in pairs in said pair of spaced dovetail grooves, each of said dovetails on each pair of bookends having sloping side walls, and a bottom wall with each dovetail or dovetail groove or both being dimensioned to provide a slight clearance between the walls of each dovetail groove and each dovetail, each dovetail in each pair of bookends dividing the bottom wall of each bookend of each pair into two parts or shoulders which are slidably supported on the top wall of said base member and hold each pair of bookends in an upright position on the top wall of said base member, said front wall and bottom wall of each bookend in each pair defining an angle of intersection of 92°, a panel having a front wall, a reverse or rear wall, an upper end wall, and a lower end wall, said panel being attached or carried on the front wall of each pair of bookends to increase the surface area of each pair that engages a book and to firmly secure the front portion of each pair of bookends in assembled engagement, a first bracket or brace member secured to the lower rear portion of each pair of bookends and extending between the inner walls of each pair of bookends and substantially vertically thereof, said first brace member firmly securing the lower rear portion of each pair of bookends in assembled engagement, and a second bracket or brace member secured to the inner bottom portions of each pair of bookends and extending between the inner walls of each pair of bookends and to the front walls thereof, said second brace member firmly securing the bottom portions of each pair of bookends in assembled engagement, said first brace member in combination with said second brace member, said panel and the inner surfaces of each pair of bookends forming a receptacle in each pair of bookends serving as a storage means, said panel on the front wall of each pair of bookends when moved into engagement with books moving each panel and the front portion of each pair of bookends upwardly and tilting or rotating each panel and front portion rearwardly to move the sloping side walls of the corresponding front portion of each dovetail of each pair of bookends into tight engagement with the sloping walls of the two dovetail grooves and move the shoulders of the rear portion of the bottom walls of each pair of bookends into firm engagement with the top wall of the base member to automatically move each pair of bookends into self-locking position to hold the books firmly together in an upright position.

14. The invention of claim 13 wherein the panel attached or carried on the front wall of each bookend in each pair is attached to each pair of bookends by means of dovetail joints, each front wall of each pair of bookends having dovetails formed thereon adapted to be slidably received in a pair of correspondingly spaced and longitudinally extending dovetail grooves formed in each panel, said pair of dovetail grooves inpanel each terminating in a longitudinally extending slot in the rear face of each panel and terminating at opposite ends in the two end walls of each panel, said termination of said grooves in the two end walls of each panel providing entry for the pair of dovetails on the front walls of each pair of bookends into each pair of grooves whereby each panel may be slidably received on each pair of dovetails.

15. The invention of claim 13 wherein the first bracket or brace member is secured to the lower rear portion of each of bookends by means of dovetail joints, said first brace member having dovetails on opposite ends thereof and being adapted to be slidably received in opposed dovetail grooves formed in the lower rear portion of each bookend in each pair, said dovetail grooves each terminating in a longitudinally extending slot in the inner face of the lower rear portion of each pair of bookends and terminating at one end in the bottom wall of the dovetail depending from the bottom wall of each bookend of each pair, said termination of said grooves in the bottom wall of each bookend of each pair providing entry for the dovetails on the opposite ends of said first brace member into said dovetail grooves.

16. The invention of claim 13 wherein said second bracket or brace member is secured to the inner bottom portion of each pair of bookends by means of a dovetail joint, said second brace member having dovetails on opposite ends thereof adapted to be slidably received in opposed dovetail grooves formed in the inner bottom portions of each pair of bookends, said dovetail grooves each terminating in a longitudinally extending slot in the inner face of the bottom portion of each pair of bookends and terminating at one end in the front wall of each bookend of each pair, said termination of said grooves in each front wall providing entry for the dovetails on the opposite ends of said second brace member into the dovetail grooves.

17. The invention of claim 13 wherein the angle of intersection is substantially 90°.

18. The invention of claim 13 wherein the angle of intersection is greater than 90°.

19. The invention of claim 13 wherein the front wall of each bookend in each pair is sloped or tapered to provide an angle of intersection between the front and bottom walls of each pair of bookends of 92°.

20. The invention of claim 13 wherein the bottom wall of each bookend in each pair is sloped or tapered to provide an angle of intersection between the front and bottom walls of each pair of bookends of 92°.

21. The invention of claim 1 wherein the components of the rack are constructed and arranged so that the components may be assembled as a kit or in kit form.

22. The invention of claim 13 wherein the components of the rack are constructed and arranged so that the components may be assembled as a kit or in kit form.

23. An adjustable and self-locking book rack or book support for securely holding books or the like in a substantially upright position comprising a base member having a dovetail groove therein, and extending the entire length thereof, at least a pair of bookends or book support members each having a front wall and a bottom wall with a dovetail depending from each bottom wall and adapted to be slidably received within said dovetail groove, said dovetail extending the entire length of said bottom wall and being formed integral with said bottom wall, said front wall and said bottom wall of each bookend intersecting and defining an angle of intersection of substantially 90° or greater, the front wall of each bookend when moved into engagement with said books moving the front wall and the front portion of each bookend upwardly and tilting or rotating said front wall and front portion rearwardly to move the front portion of each dovetail into tight engagement with the walls of the dovetail groove and move the the rear portion of the bottom wall of each bookend downwardly into firm engagement with the base member to thereby move the bookends into a self-locking position and hold the books firmly together in the substantially upright position on the base member.

24. An adjustable and self-locking book rack or book support for securely holding books or the like in a substantially upright position comprising a base member having a pair of dovetail grooves therein, at least two bookends or book support members each comprised of a pair of bookends with each bookend in each pair having a front wall and a bottom wall with a dovetail depending from each bottom wall in each pair and adapted to be slidably received in pairs in said pair of dovetail grooves, said front wall and bottom wall of each bookend in each pair intersecting and defining an angle of intersection of substantially 90° or greater, panel means being carried on the front wall of each pair of bookends to increase the surface area of each pair that engages a book and to firmly secure the front portion of each pair of bookends in assembled engagement, first brace means attached to the lower rear portion of each pair of bookends for firmly securing the lower rear portions of each pair of bookends in assembled engagement, and second brace means attached to the bottom portions of each pair of bookends for firmly securing the bottom portions of each pair in assembled engagement, said panel means on the front wall of each pair of bookends when moved into engagement with said books moving each panel means and the front portion of each pair of bookends upwardly and tilting or rotating each panel means and front portion rearwardly to move the front portion of each dovetail of each pair of bookends into tight engagement with the walls of the two dovetail grooves and move the rear portions of the bottom walls of each pair of bookends into firm engagement with the base member to move each pair of bookends into a self-locking position and hold the books firmly together in the substantially upright position on the base member.

* * * * *